US010220527B1

(12) United States Patent
Marfione

(10) Patent No.: US 10,220,527 B1
(45) Date of Patent: Mar. 5, 2019

(54) SWITCHBLADE

(71) Applicant: Microtech Knives, Inc., Bradford, PA (US)

(72) Inventor: Anthony Marfione, Fletcher, NC (US)

(73) Assignee: Microtech Knives, Bradford, PA (US)

( * ) Notice: Subject to any disclaimer, the term of this patent is extended or adjusted under 35 U.S.C. 154(b) by 59 days.

(21) Appl. No.: 15/694,308

(22) Filed: Sep. 1, 2017

(51) Int. Cl.
*B26B 1/08* (2006.01)
*B26B 9/02* (2006.01)

(52) U.S. Cl.
CPC . *B26B 1/08* (2013.01); *B26B 9/02* (2013.01)

(58) Field of Classification Search
CPC .. B26B 5/00; B26B 5/002; B26B 1/00; B26B 1/08
USPC ..... 30/153, 155–162
See application file for complete search history.

(56) References Cited

U.S. PATENT DOCUMENTS 1,056,404 A * 3/1913 Lorenzo ..... B26B 21/06 30/161
1,231,058 A * 6/1917 Pansa ..... F41C 27/16 30/161
2,854,745 A * 10/1958 Braverman ..... B26B 1/08 30/162
4,089,112 A * 5/1978 Richards ..... B26B 5/001 30/162
4,523,379 A * 6/1985 Osterhout ..... B26B 29/025 30/151
4,744,146 A * 5/1988 Schmidt ..... B26B 5/001 30/125
4,947,552 A * 8/1990 Barnes ..... B26B 1/046 30/159
5,060,379 A * 10/1991 Neely ..... B26B 1/048 30/155
5,511,311 A * 4/1996 Collins ..... B26B 1/08 224/232
5,617,635 A * 4/1997 Berns ..... B26B 1/08 30/162
6,085,423 A * 7/2000 Marifone ..... B26B 1/08 30/151
6,148,522 A * 11/2000 Dobandi ..... B26B 5/001 30/162
6,154,965 A * 12/2000 Sakai ..... B26B 1/048 30/160
7,086,158 B1 * 8/2006 Halpern ..... B26B 1/08 30/162
7,305,729 B2 * 12/2007 Dehner ..... B26B 5/003 30/162

(Continued)

*Primary Examiner* — Jason Daniel Prone
*Assistant Examiner* — Richard D Crosby, Jr.
(74) *Attorney, Agent, or Firm* — Steve LeBlanc, LLC

(57) ABSTRACT

A switchblade includes a casing that defines a cavity and a blade having a cutting edge. The blade has a retracted position in which the cutting edge is inside the cavity and a deployed position in which the cutting edge is outside of the cavity. A spring is operably connected to the blade to bias the blade to the deployed position. An actuator extends through at least a portion of the casing and has a hold position that engages with the blade to prevent movement of the blade with respect to the casing and a release position that permits movement of the blade with respect to the casing. A safety is operably connected to the actuator and has a lock position that prevents operation of the actuator and an unlock position that permits operation of the actuator.

15 Claims, 10 Drawing Sheets

(56) References Cited

U.S. PATENT DOCUMENTS

| | | | | |
|---|---|---|---|---|
| 7,305,769 | B2 * | 12/2007 | McHenry | B26B 1/08 30/162 |
| 7,337,546 | B2 * | 3/2008 | Cheng | B26B 1/04 30/156 |
| 7,621,051 | B2 * | 11/2009 | Ping | B26B 5/00 30/162 |
| 7,647,702 | B2 * | 1/2010 | Polei | B26B 5/001 30/162 |
| 7,698,821 | B2 * | 4/2010 | Ralph | B26B 1/048 30/158 |
| 7,797,838 | B2 * | 9/2010 | Chu | B26B 1/08 30/151 |
| 7,979,990 | B2 | 7/2011 | Hawk et al. | |
| 8,375,588 | B2 * | 2/2013 | Gringer | B26B 5/001 30/154 |
| 8,595,941 | B2 * | 12/2013 | Lee | B26B 1/08 30/151 |
| 8,671,578 | B1 * | 3/2014 | Frazer | B26B 1/08 30/151 |
| 9,205,569 | B2 * | 12/2015 | Garavaglia | B26B 1/10 |
| 9,573,282 | B1 | 2/2017 | Sheahan | |
| 9,676,105 | B2 * | 6/2017 | McChesney | B26B 1/08 |
| 2003/0154605 | A1 * | 8/2003 | Chao | B26B 5/001 30/162 |
| 2011/0283543 | A1 * | 11/2011 | Wu | B26B 5/001 30/162 |
| 2012/0216412 | A1 * | 8/2012 | Chung | B26B 5/00 30/143 |
| 2013/0160300 | A1 * | 6/2013 | Liu | B26B 1/048 30/159 |
| 2017/0015009 | A1 * | 1/2017 | Tseng | B26B 5/001 |
| 2017/0246747 | A1 * | 8/2017 | Schmidt | B26B 5/003 |

* cited by examiner

SWITCHBLADE

FIELD OF THE INVENTION

The present invention generally involves a switchblade. In particular embodiments, the switchblade may be single or double action in either a folding or out-the-front configuration.

BACKGROUND OF THE INVENTION

Pocket knives provide a convenient tool for cutting that may be easily carried by a user for deployment when desired. For some pocket knife designs, two hands are needed to deploy and retract a blade, while other designs include a spring that assists a user to deploy or retract the blade using a single hand. Each design balances the convenience and speed of operation with increased risk associated with inadvertent operation.

A switchblade is a particular style of pocket knife that has a folding or sliding blade that automatically deploys when an actuator is operated. For a single action switchblade, a spring under compression may be engaged with the blade, and operation of the actuator releases the blade to allow the spring to automatically deploy the blade. Once deployed, the actuator is released to hold the blade in the deployed position. To retract a single action switchblade, the actuator is again operated to release the blade, and the blade must be manually retracted. For example, a single action switchblade design may include a charging handle that may be manually operated to retract the blade. For a double action switchblade, operation of the actuator compresses a spring against the blade to automatically deploy and retract the blade.

Although a switchblade provides convenient one-handed operation, the convenience of operation also increases the risk that the actuator may be inadvertently operated. For example, the actuator may be inadvertently bumped while the switchblade is in a pocket or attached to a belt, automatically deploying the blade in a manner that may cause personal injury or damage. Alternately, the actuator may be inadvertently bumped while the switchblade is deployed, releasing the blade from a fixed position. In addition, for single action switchblades that include a charging handle, the charging handle can create a pinch point during automatic deployment of the blade. As a result, the need exists for an improved actuator that reduces inadvertent operation of the actuator and an improved charging handle that reduces or eliminates the pinch point during automatic deployment of the blade.

BRIEF DESCRIPTION OF THE INVENTION

Aspects and advantages of the invention are set forth below in the following description, or may be obvious from the description, or may be learned through practice of the invention.

One embodiment of the present invention is a switchblade that includes a casing that defines a cavity. A blade having a cutting edge has a retracted position in which the cutting edge is inside the cavity and a deployed position in which the cutting edge is outside of the cavity. A spring is operably connected to the blade to bias the blade to the deployed position. An actuator extends through at least a portion of the casing and has a hold position that engages with the blade to prevent movement of the blade with respect to the casing and a release position that permits movement of the blade with respect to the casing. A safety is operably connected to the actuator and has a lock position that prevents operation of the actuator and an unlock position that permits operation of the actuator.

An alternate embodiment of the present invention is a switchblade that includes a casing that defines a cavity and a blade having a cutting edge. The blade has a retracted position in which the cutting edge is inside the cavity and a deployed position in which the cutting edge is outside of the cavity. A spring is operably connected to the blade to bias the blade to the deployed position. An actuator is releasably engaged with the blade and has a hold position that engages with the blade to prevent movement of the blade with respect to the casing and a release position that permits movement of the blade with respect to the casing. A safety is operably connected to the actuator and has a lock position that prevents operation of the actuator and an unlock position that permits operation of the actuator.

In yet another embodiment of the present invention, a switchblade includes a casing that defines a cavity and a blade having a cutting edge. The blade has a retracted position in which the cutting edge is inside the cavity and a deployed position in which the cutting edge is outside of the cavity. A spring is operably connected to the blade to bias the blade to the deployed position. An actuator extends through at least a portion of the casing and has a hold position that engages with the blade to prevent movement of the blade with respect to the casing and a release position that permits movement of the blade with respect to the casing. A charging handle is in sliding engagement with the casing and moves with respect to the casing to engage the blade to overcome the spring bias to move the blade to the retracted position. A releasable latch is pivotally connected to the charging handle.

Those of ordinary skill in the art will better appreciate the features and aspects of such embodiments, and others, upon review of the specification.

BRIEF DESCRIPTION OF THE DRAWINGS

A full and enabling disclosure of the present invention, including the best mode thereof to one skilled in the art, is set forth more particularly in the remainder of the specification, including reference to the accompanying figures, in which.

DETAILED DESCRIPTION OF THE INVENTION

Figure 1:
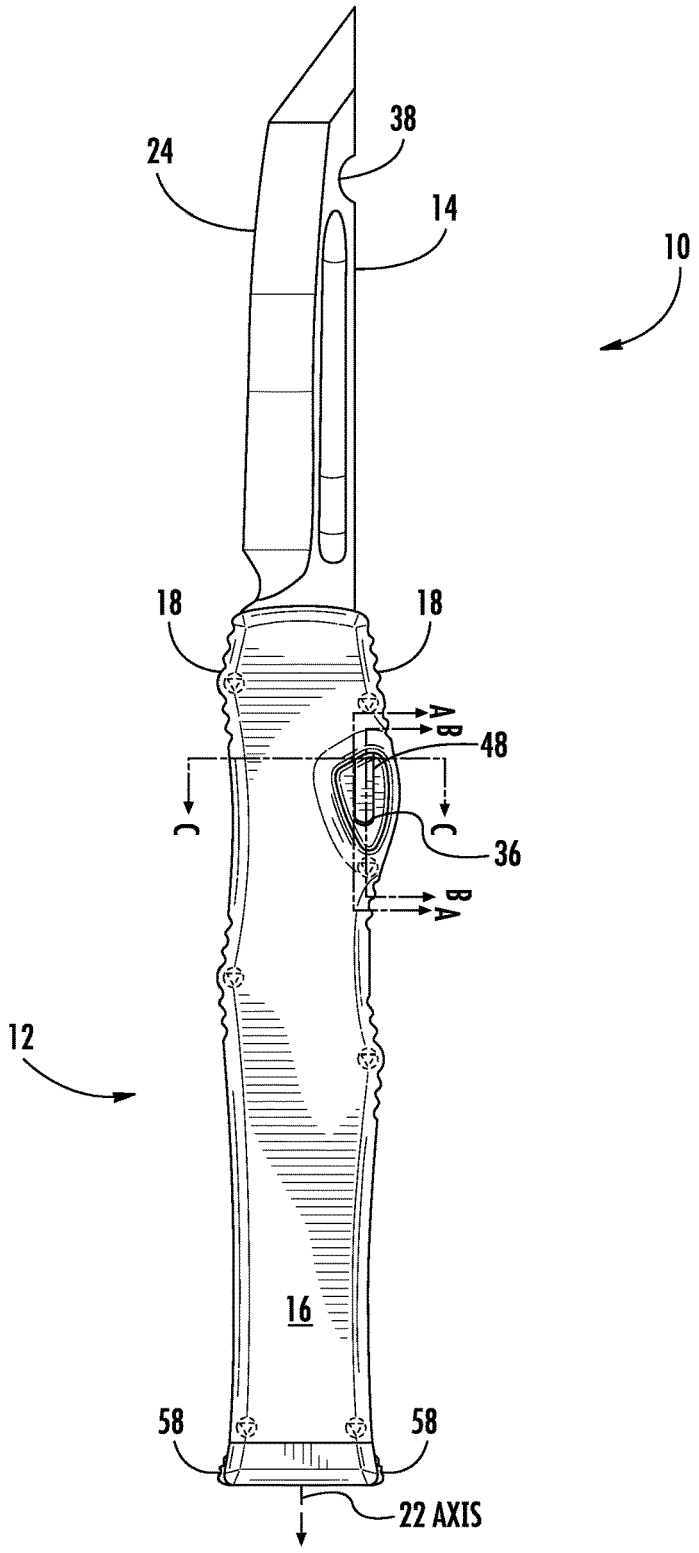
FIG. 1 is a side plan view of a switchblade according to one embodiment of the present invention.

Reference will now be made in detail to present embodiments of the invention, one or more examples of which are illustrated in the accompanying drawings. The detailed description uses numerical and letter designations to refer to features in the drawings. Like or similar designations in the drawings and description have been used to refer to like or similar parts of the invention. Each example is provided by way of explanation of the invention, not limitation of the invention. In fact, it will be apparent to those skilled in the art that modifications and variations can be made in the present invention without departing from the scope or spirit thereof. For instance, features illustrated or described as part of one embodiment may be used on another embodiment to yield a still further embodiment. Thus, it is intended that the present invention covers such modifications and variations as come within the scope of the appended claims and their equivalents.

Embodiments of the present invention include a switchblade with an actuator and safety that provides enhanced protection against inadvertent deployment of the switchblade. Alternately or in addition, the switchblade may include a charging handle and one or more latches that engage the charging handle to a casing to reduce or eliminate a pinch point between the charging handle and the casing. Although various embodiments are illustrated as an out-the-front (OTF), single action switchblade, one of ordinary skill in the art will readily appreciate that embodiments of the present invention may include a folding switchblade and/or a double action switchblade, and the present invention is not limited to a particular configuration or action unless specifically recited in the claims.

Figure 2:
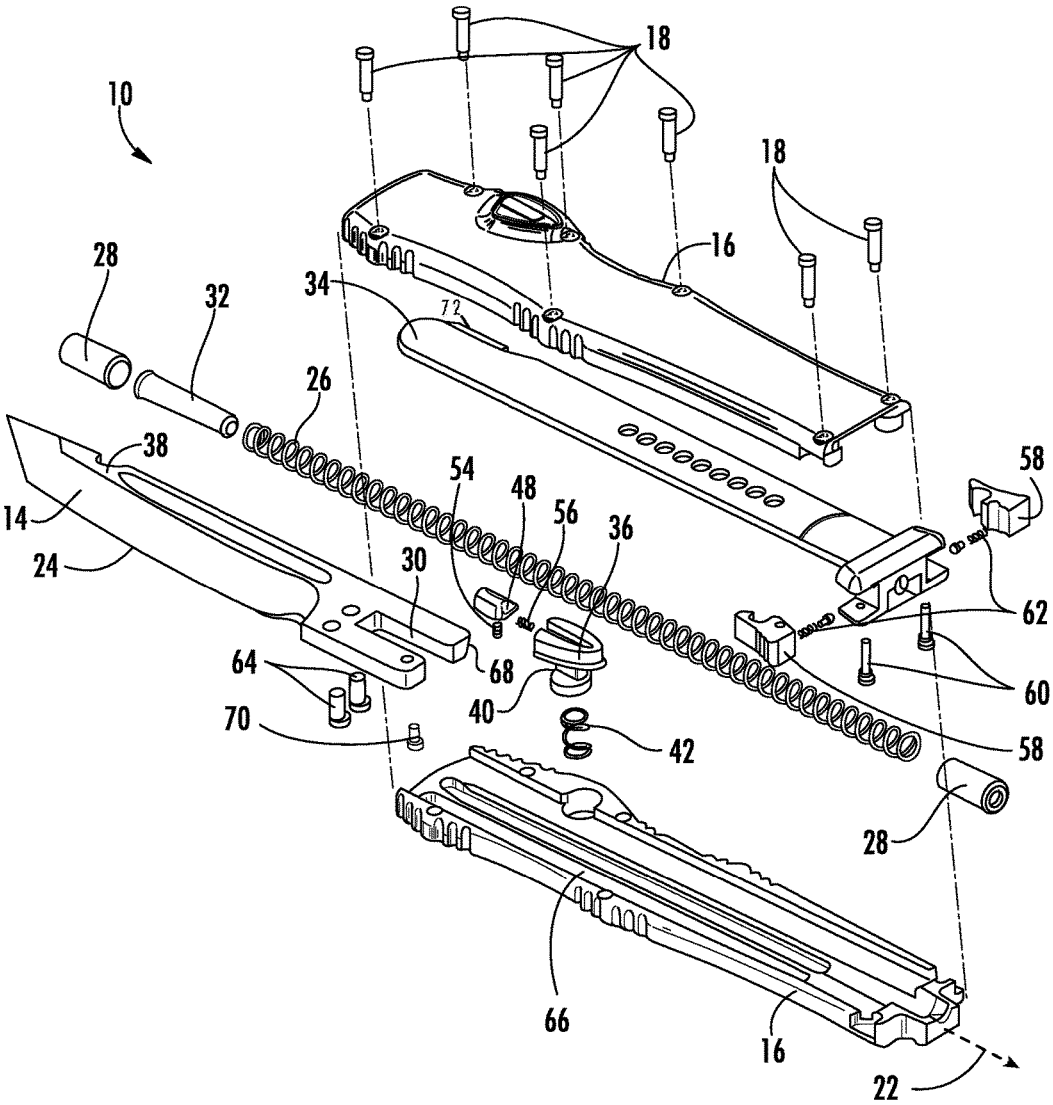
FIG. 2 is an exploded view of the embodiment shown in FIG. 1.

FIG. 1 provides a plan view of a switchblade 10 according to one embodiment of the present invention, and FIG. 2 provides an exploded view of the switchblade 10 shown in FIG. 1. As shown in FIGS. 1 and 2, the switchblade 10 generally includes a casing 12 that houses and supports a blade 14. The casing 12 typically includes a pair of complementary scales 16 connected together by screws 18 to define a cavity 20 between the scales 16. The cavity 20 generally extends along a longitudinal axis 22 between the scales 16. The blade 12 typically includes a cutting edge 24 on one or both sides of the blade 12. In particular embodiments, the cutting edge 24 may be curved, straight, and/or serrated. The blade 12 has a retracted position (shown in FIGS. 8 and 9) in which the cutting edge 24 is housed inside the cavity 20 and a deployed position (shown in FIG. 1) in which the cutting edge 24 is supported outside of the cavity 20 by the casing 12.

The switchblade 10 includes various components housed inside the cavity 20 that enable the switchblade 10 to transition between the retracted and deployed positions. The particular components and their operation depend on the design and desired functionality of the switchblade 10, and an exemplary illustration of one such design is provided in FIG. 2. As shown in FIG. 2, the switchblade 10 may include a charging spring 26 operably connected to the blade 14 to bias the blade 14 to the deployed position. A pair of charging spring caps 28 may be fixedly connected to an insert 30 of the blade 14 at one end and the casing 12 at the other end. A charging spring guide 32 may facilitate collapse of the spring 26 under pressure in the retracted position. A charging handle 34 may be in sliding engagement with the casing 12 between the complimentary scales 16 so that the charging handle 34 may move with respect to the casing 12. As will be described with respect to operation of the switchblade 10, the charging handle 34 may move between a home position (shown in FIG. 11) in which it is fully inserted in the casing 12 and a withdrawn position in which it is pulled from the casing 12 to compress the charging spring 26 and move the blade 14 to the retracted position.

An actuator 36 may extend through at least a portion of the casing 12 to releasably engage or disengage with a detent 38 defined by the blade 14. For example, the actuator 36 may have a hold position (shown in FIGS. 3-6) in which the actuator 36 engages with the detent 38 defined by the blade 14 to prevent movement of the blade 14 with respect to the casing 12. Alternately or in addition, the actuator 36 may have a release position (shown in FIG. 7) in which the actuator 36 disengages from the detent 38 and permits movement of the blade 14 with respect to the casing 12.

Figure 3:
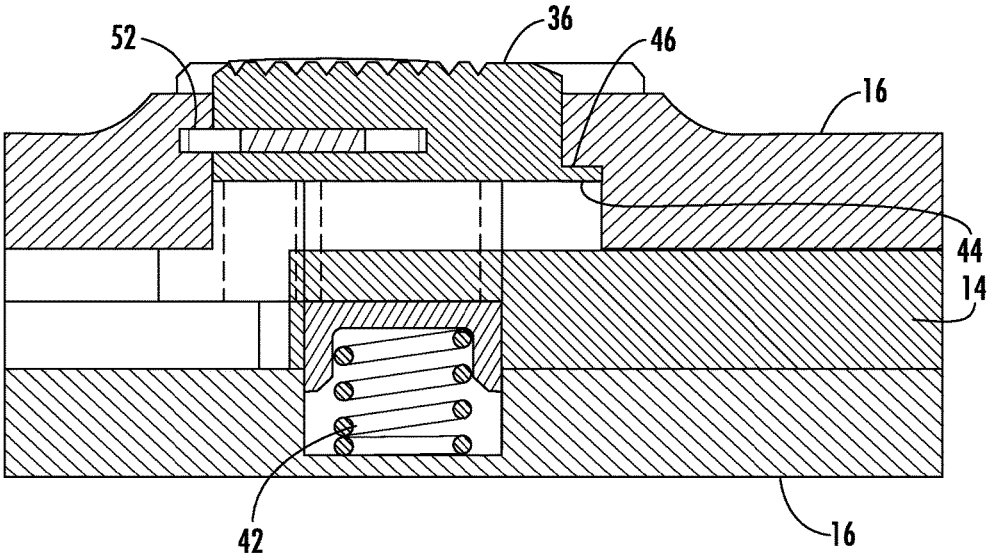
FIG. 3 is a cross-section view of the embodiment shown in FIG. 1 taken along line A-A with the actuator in the hold position.
Figure 4:
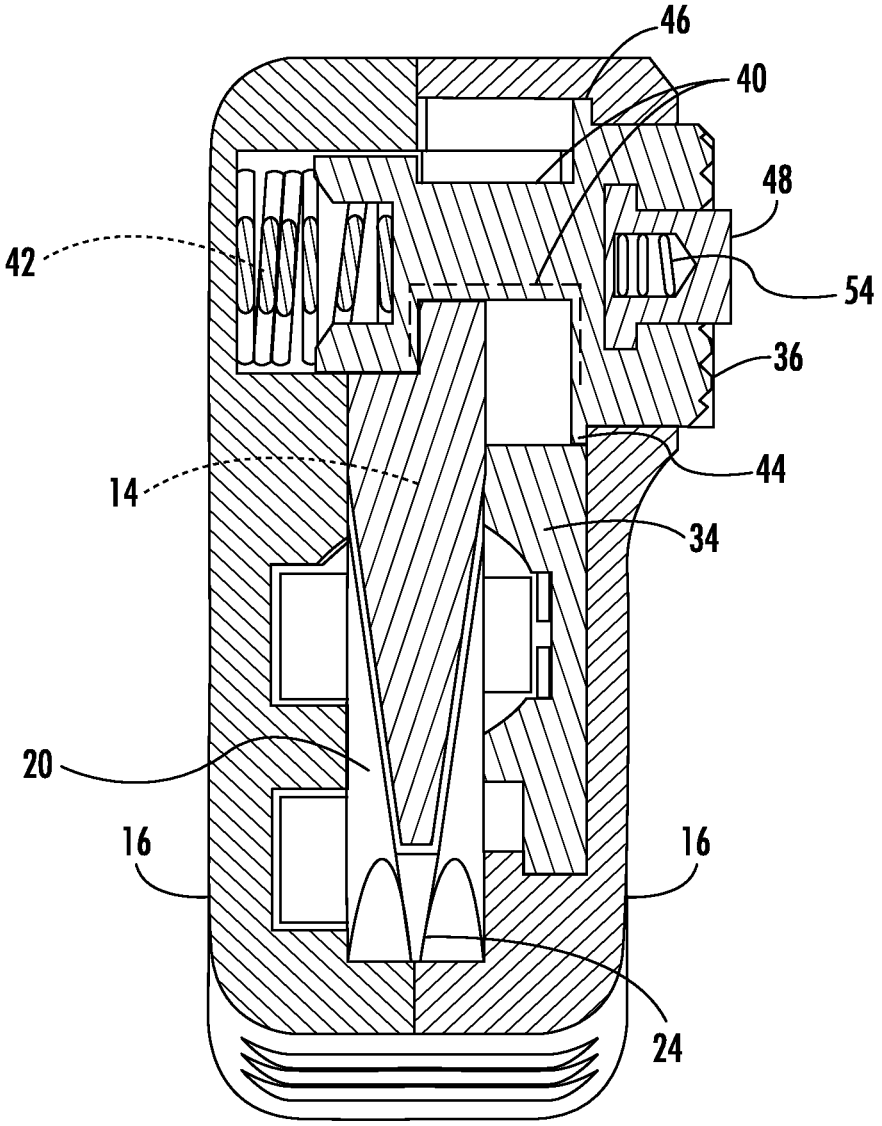
FIG. 4 is a cross-section view of the embodiment shown in FIG. 1 taken along line C-C with the actuator in the hold position.

FIGS. 3 and 4 provide cross-section views of the switchblade 10 shown in FIG. 1 taken along line A-A with the actuator 36 in the hold position. As shown in FIGS. 3 and 4, the actuator 36 may extend through one of the scales 16 in a direction generally perpendicular to the longitudinal axis 22 of the casing 12 and cavity 20. The outer portion of the actuator 36 may have a surface and shape suitable for thumb or finger manipulation, and the inner portion of the actuator 36 extending into the cavity 20 may have a shape that generally matches the shape of the detent 38 in the blade 14. For example, as shown most clearly in FIG. 2, the inner portion of the actuator 36 may be cylindrical to closely fit in the semi-circular detent 38 defined by the blade 14. As shown most clearly in FIG. 4, the inner portion of the actuator 36 may include a relief slot 40 having a width approximately equal to the width of the blade 14. An actuator spring 42 between the actuator 36 and the opposing scale 16 may bias the actuator 36 outward, and a projection 44 of the actuator 36 may engage with a flange 46 in the scale 16 to prevent ejection of the actuator 36 from the casing 12. In this manner, the actuator spring 42 biases the actuator 36 to the hold position in which the cylindrical portion of the actuator 36 fits in the detent 38 to engage with the blade 14 to prevent movement of the blade 14 with respect to the casing 12.

A safety 48 may be operably connected to actuator 36 to provide enhanced protection against inadvertent operation of the actuator 36. The safety 48 has a lock position (shown in FIG. 5) that prevents operation of actuator 36 and an unlock position (shown in FIG. 6) that permits operation of the actuator 36.

Figure 5:
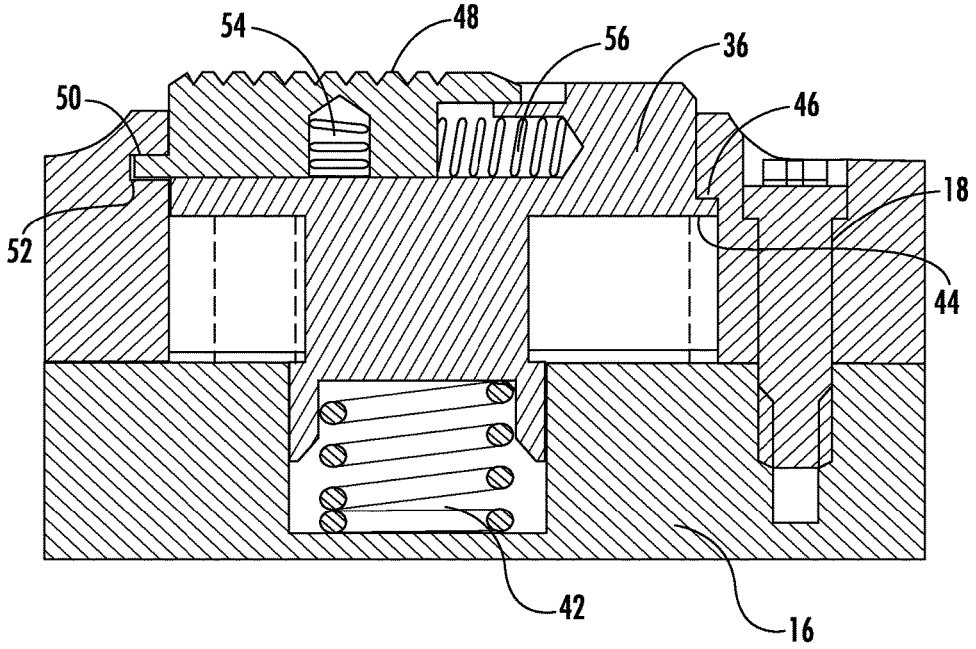
FIG. 5 is a cross-section view of the embodiment shown in FIG. 1 taken along line B-B with the actuator in the hold position and the safety in the lock position.

FIG. 5 provides a cross-section view of the switchblade 10 shown in FIG. 1 taken along line B-B with the actuator 36 in the hold position and the safety 48 in the lock position. As shown in FIG. 5, the safety 48 may define a projection 50 that fits in and engages with a complementary recess 52 defined by the casing 12 when the safety 48 is in the lock position. A first spring 54 between the safety 48 and the actuator 36 may bias the safety 48 outward and away from the actuator 36 to reduce vibration or rattling between the safety 48 and the actuator 36. A second spring 56 between the safety 48 and the actuator 36 and generally perpendicular to the first spring 54 may bias the safety 48 away from the actuator 36 toward the front of the casing 12. In this manner, the second spring 56 biases the safety 48 to the lock position in which the projection 50 of the safety 48 engages with the recess 52 of the casing 12 to prevent operation of the actuator 36.

Figure 6:
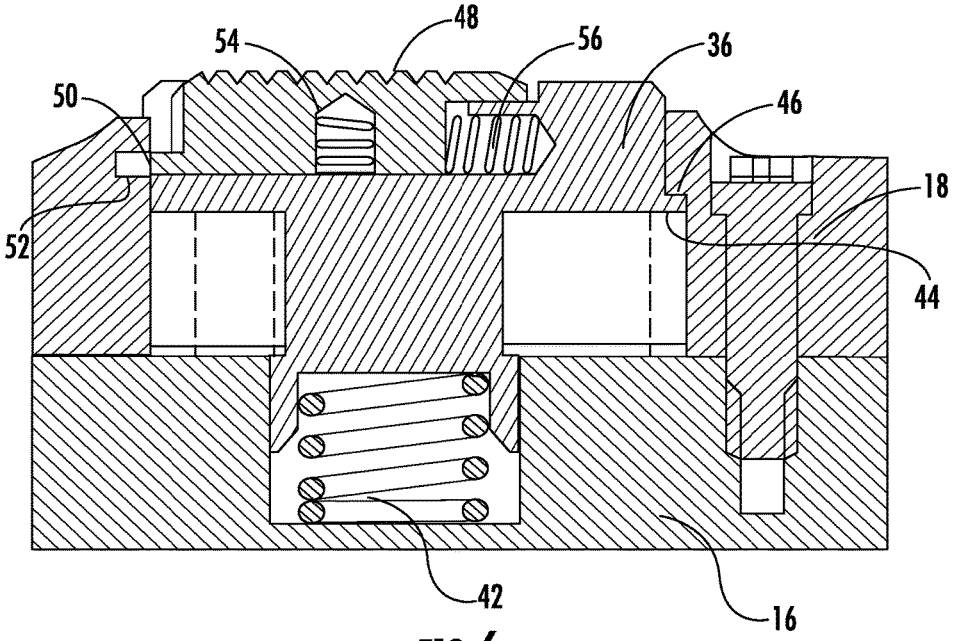
FIG. 6 is a cross-section view of the embodiment shown in FIG. 1 taken along line B-B with the actuator in the hold position and the safety in the unlock position.

FIG. 6 provides is a cross-section view of the switchblade 10 shown in FIG. 1 taken along line B-B with the actuator 36 in the hold position and the safety 48 in the unlock position. As shown in FIG. 6, the safety 48 has been moved to the right or rear of the switchblade 10 and held in place to overcome the bias provided by the second spring 56. This movement of the safety 48 from the lock position to the unlock position is generally perpendicular to the movement of the actuator 36 from the hold position to the release position. As a result of this movement of the safety 48, the projection 50 of the safety 48 is no longer engaged with the recess 52 in the casing 12, and the safety 48 is in the unlock position that enables operation of the actuator 36.

Figure 7:
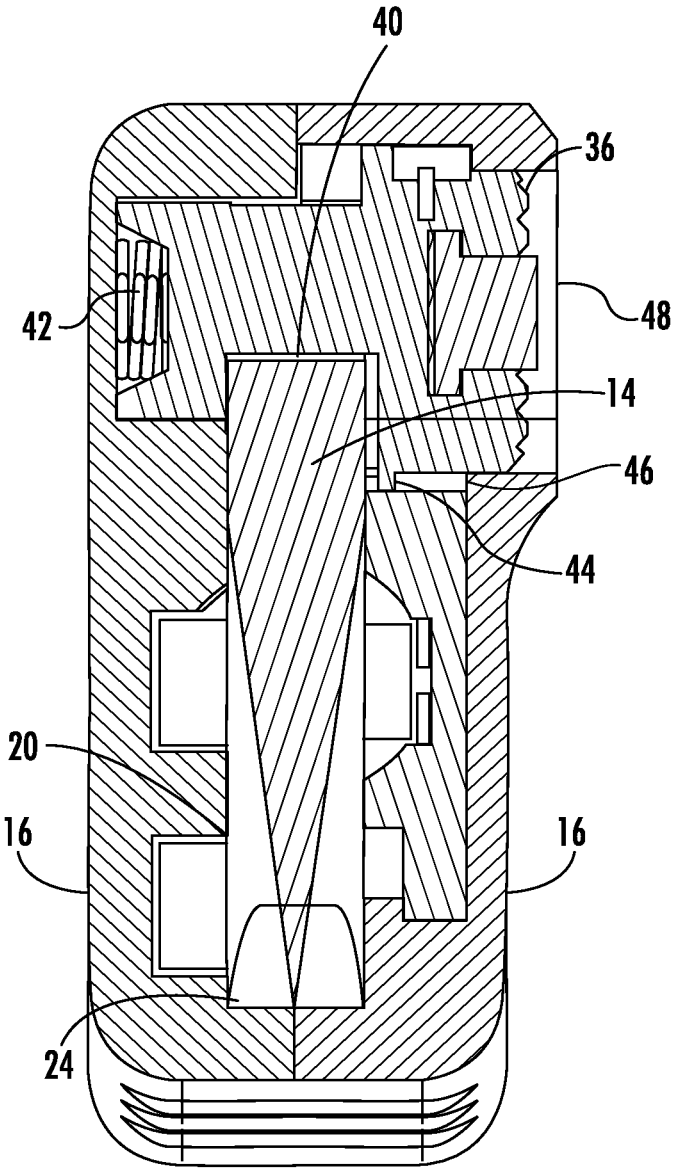
FIG. 7 is a cross-section view of the embodiment shown in FIG. 1 taken along line C-C with the actuator in the release position.

FIG. 7 provides a cross-section view of the switchblade 10 shown in FIG. 1 taken along line C-C with the actuator 36 in the release position. As shown in FIG. 7, the actuator 36 has been depressed into the cavity 20 to align the relief slot 40 with the blade 14. In this alignment, the actuator 36 is in the release position that permits movement of the blade 14 with respect to casing 12 to allow the blade to be retracted or deployed.

Figure 8:
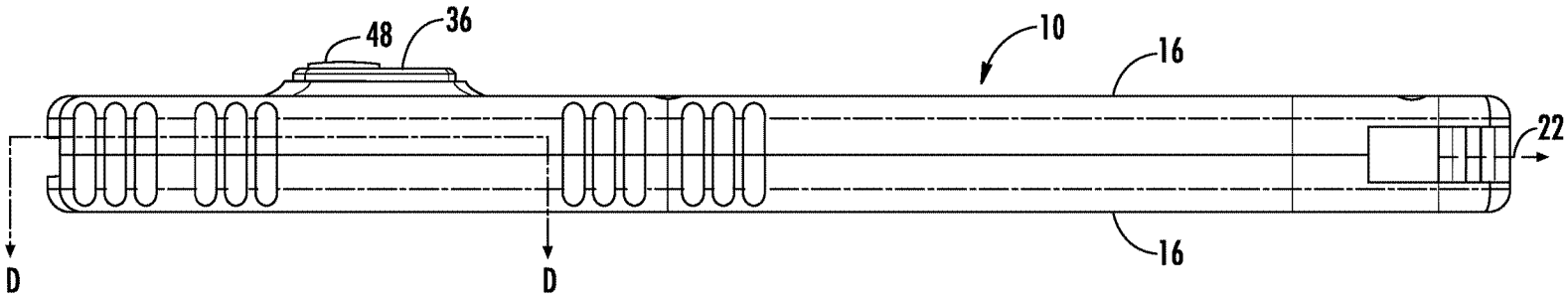
FIG. 8 is a back plan view of the embodiment shown in FIG. 1 with the blade in the retracted position.
Figure 9:
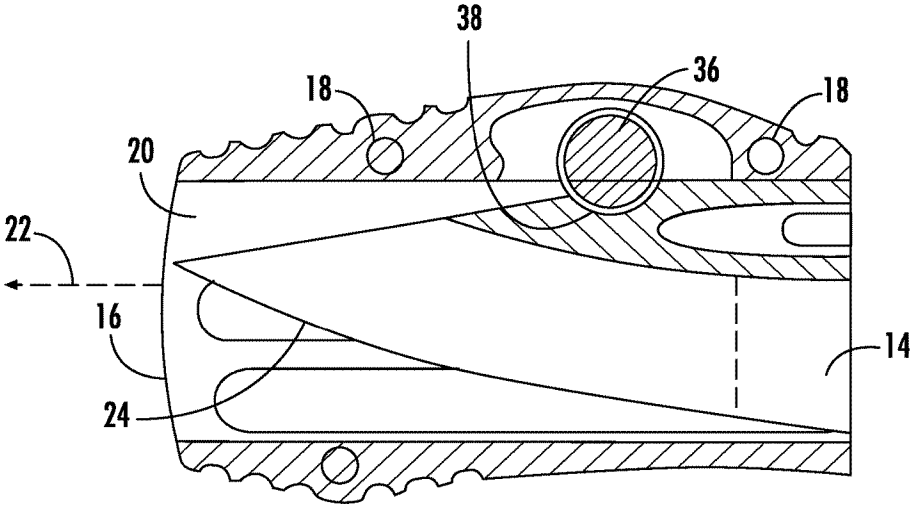
FIG. 9 is a cross-section view of the front of the embodiment shown in FIG. 8 taken along line D-D with the blade in the retracted position.

FIG. 8 provides a back plan view of the switchblade 10 shown in FIG. 1 with the blade 14 in the retracted position, and FIG. 9 provides a cross-section view of the front of the switchblade 10 shown in FIG. 8 taken along line D-D. As shown in FIG. 9, the actuator 36 is in the hold position so the inner portion of the actuator 36 engages with the detent 38 defined by the blade 14 to prevent movement of the blade 14 with respect to the casing 12.

Figure 10:
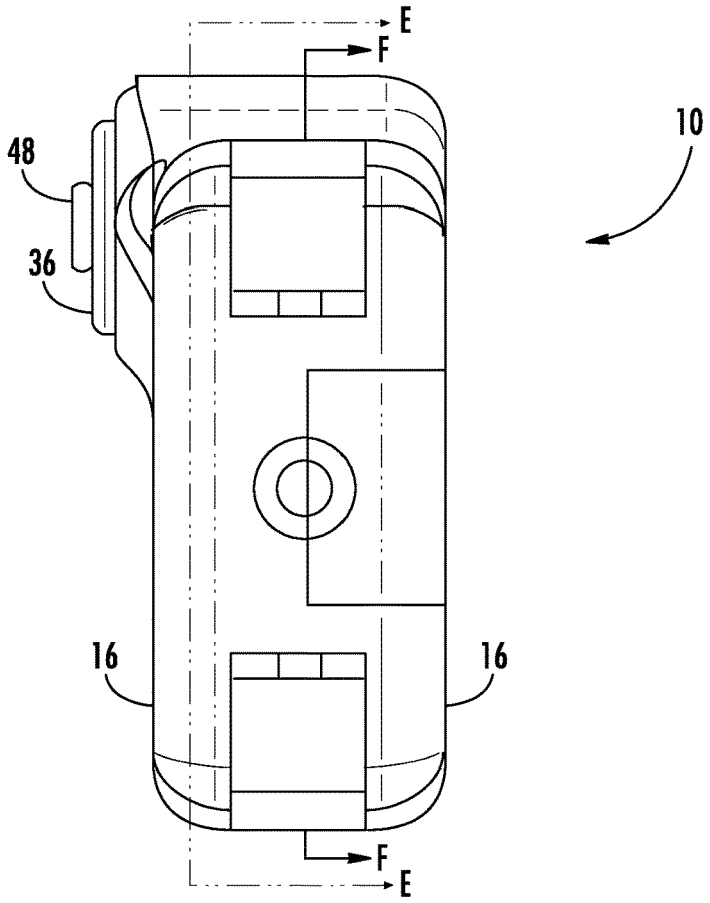
FIG. 10 is an end plan view of the embodiment shown in FIG. 1.
Figure 11:
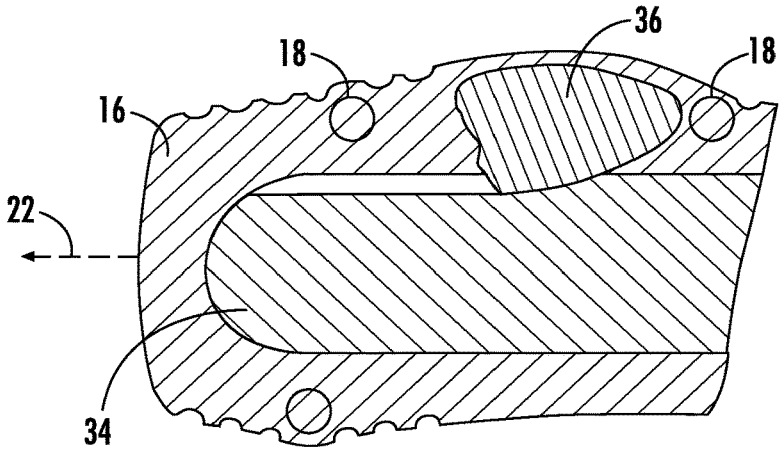
FIG. 11 is a cross-section view of the front of the embodiment shown in FIG. 10 taken along line E-E showing the charging handle in the home position.

FIG. 10 provides an end plan view of the switchblade 10 shown in FIG. 1, and FIG. 11 provides a cross-section view of the front of the switchblade 10 shown in FIG. 10 taken along line E-E showing the charging handle 34 in the home position. As shown in FIG. 11, the charging handle 34 is in the home position fully inserted into the casing 12, and the actuator 36 may engage a surface of the charging handle 34 to reduce vibration and rattling. In addition, as shown in FIG. 2, the forward portion of the charging handle may include an extension 72 that interferes with the inner portion of the actuator 36 unless the charging handle 34 is in the home position. In this manner, the extension 72 of the charging handle 34 may prevent operation of the actuator 36 unless the charging handle 34 is fully inserted in the home position to reduce or eliminate the presence of a pinch point between the charging handle 34 and the casing 12.

Figure 12:
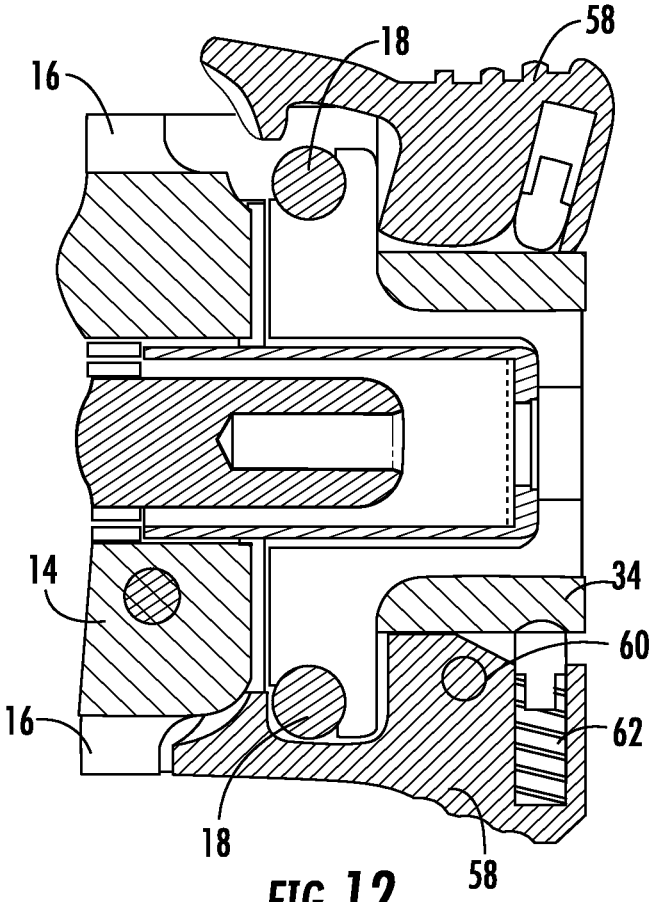
FIG. 12 is a cross-section view of the rear of the embodiment shown in FIG. 10 taken along line F-F with the charging handle in the home position.

FIG. 12 provides a cross-section view of the rear of the switchblade 10 shown in FIG. 10 taken along line F-F with the charging handle 34 in the home position. As shown in FIGS. 2 and 12, the switchblade 10 may further include one or more releasable latches 58 between the charging handle 34 and the casing 12. Each latch 58 may be pivotally connected to either the casing 12 or the charging handle 34 for releasable engagement with the other to secure the charging handle 34 to the casing 12 in the home position. For example, as shown in FIGS. 2 and 12, each latch 58 may be pivotally connected to the charging handle 34 using a pivot pin 60. In particular embodiments, each latch 58 may further include a latch spring 62 between the latch 58 and the charging handle 34 to pivotally bias the latch 58 to engage with the casing 12. In this manner, the latch springs 62 bias the latches 58 to engage with the screws 18 in the casing 12. To release the latches 58, a user may pinch the ends of the latches 58 together to overcome the latch spring 62 bias to pivotally disengage the latches 58 from the casing 12.

Operation of the switchblade 10 will now be described with respect to FIGS. 1-12. Starting with the blade 12 in the retracted position (FIGS. 8 and 9), the actuator 36 is in the hold position (FIGS. 3-5), and the safety 48 is in the lock position (FIG. 5). In this initial retracted position, the charging spring 26 is under compression with the blade 14 inside the cavity 20. The actuator spring 42 biases the actuator 36 outward, and the inner portion of the actuator 36 engages with the detent 38 in the blade 14 to hold the blade 14 inside the cavity 30 to prevent movement of the blade 14 with respect to the casing 12 (FIG. 9). In addition, the projection 50 defined by the safety 48 engages with the recess 52 in the casing 12 to prevent inadvertent inward movement or operation of the actuator 36.

To deploy the blade 14, the user first moves the safety 48 to the unlock position (FIG. 6) by sliding the safety 48 to the right or rear of the switchblade 10 to overcome the bias provided by the second spring 56. As a result of this movement of the safety 48, the projection 50 of the safety 48 is no longer engaged with the recess 52 in the casing 12, and the safety 48 is in the unlock position that enables operation of the actuator 36. While holding the safety 48 in the unlock position, the user may then depress the actuator 36 into the cavity 20 to overcome the actuator spring 42 bias and align the relief slot 40 with the blade 14 (FIG. 7). In this alignment, the actuator 36 is in the release position that permits movement of the blade 14 with respect to casing 12, and the charging spring 26 pushes the blade 14 linearly and parallel to the longitudinal axis 22 to move the blade 14 from the retracted position to the deployed position (FIG. 1). The blade 14 is fully deployed when stop pins 64 in the blade 14 reach the end of grooves 66 in the scale 16 (FIG. 2). The user may then release the actuator 36 and safety 48, allowing the actuator spring 42 to bias the actuator 36 outward to return the actuator 36 to the hold position and the second spring 56 to bias the safety 48 forward to the lock position. With the actuator 36 again in the hold position and the blade 14 fully deployed, the relief slot 40 is no longer aligned with the blade 14, and the inner portion of the actuator 36 engages with an end 70 of the blade 14 to again prevent movement of the blade 14 with respect to the casing. The blade 14 is now in the deployed position with the actuator 36 in the hold position to prevent the blade 14 from retracting and the safety 48 in the lock position to prevent inadvertent operation of the actuator 36.

To retract the blade 14, the user moves the safety 48 to the unlock position (FIG. 6) by sliding the safety 48 to the right or rear of the switchblade 10 to overcome the bias provided by the second spring 56. As a result of this movement of the safety 48, the projection 50 of the safety 48 is no longer engaged with the recess 52 in the casing 12, and the safety 48 is in the unlock position that enables operation of the actuator 36. While holding the safety 48 in the unlock position, the user may then depress the actuator 36 into the cavity 20 to overcome the actuator spring 42 bias and align the relief slot 40 with the blade 14 (FIG. 7). In this alignment, the actuator 36 is in the release position that permits movement of the blade 14 with respect to casing 12.

The user may then pinch the ends of the latches 58 together to overcome the latch spring 62 bias to disengage the latches 58 from the casing 12. With the actuator 36 depressed and the latches 58 disengaged from the casing 12, the user may then withdraw the charging handle 34 from the casing 12 or cavity 20. As the charging handle 34 is withdrawn, the charging handle 34 engages with a charging pin 70 connected to the blade 14 to compress the charging spring 26 and pull the blade 14 linearly and parallel to the longitudinal axis 22 back inside the casing 12 or cavity 20. As the blade 14 begins to move back into the casing 12 or cavity 20, the user may release the actuator 36 and safety 48. However, the sliding blade 14 is aligned with the relief slot 40 (FIG. 7), preventing the actuator 36 from returning to the hold position. When the blade 14 reaches the fully retracted position, the detent 38 in the blade 14 aligns with the inner portion of the actuator 36. As a result, the actuator spring 42 biases the actuator 36 outward to return the actuator 36 to the hold position, and the second spring 56 biases the safety 48 forward to return the safety 48 to the lock position. The user may then push the charging handle 34 back into the casing 12 or cavity 20 and release the latches 58. The latch springs 62 pivotally bias the latches 58 into engagement with the casing 12. The blade 14 is again in the retracted position, with the actuator 36 in the hold position to prevent the blade 14 from deploying and the safety 48 in the lock position to prevent inadvertent operation of the actuator 36. The charging handle 34 is also in the home position and held in place by the latches 58.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal language of the claims.

What is claimed is:

1. A switchblade, comprising:

a casing, wherein said casing defines a cavity;

a blade having a cutting edge, wherein said blade has a retracted position in which said cutting edge is inside said cavity and a deployed position in which said cutting edge is outside of said cavity;

a spring operably connected to said blade to bias said blade to said deployed position;

an actuator that extends through at least a portion of said casing, wherein said actuator has a hold position that engages with said blade so that said actuator prevents movement of said blade with respect to said casing and a release position that permits movement of said blade with respect to said casing; and a safety operably connected to said actuator, wherein said safety has a lock position that prevents operation of said actuator and an unlock position that permits operation of said actuator, wherein said safety is biased in said lock position.

2. The switchblade as in claim 1, wherein said safety defines a projection, said casing defines a recess, and said projection of said safety is engaged with said recess of said casing when said safety is in said lock position and disengaged from said recess when said safety is in said unlock position.

3. The switchblade as in claim 1, wherein said safety moves in a first direction from said lock position to said unlock position, said actuator moves in a second direction from said hold position to said release position, and said first direction is perpendicular to said second direction.

4. The switchblade as in claim 1, wherein said blade moves parallel to a longitudinal axis of said cavity when said blade moves from said retracted position to said deployed position.

5. The switchblade as in claim 1, further comprising a charging handle in sliding engagement with said casing, wherein said charging handle moves with respect to said casing to engage said blade to overcome said spring bias to move said blade to said retracted position.

6. The switchblade as in claim 5, further comprising a releasable latch between said charging handle and said casing.

7. The switchblade as in claim 6, wherein said releasable latch is pivotally connected to said charging handle.

8. A switchblade, comprising:

a casing, wherein said casing defines a cavity;

a blade having a cutting edge, wherein said blade has a retracted position in which said cutting edge is inside said cavity and a deployed position in which said cutting edge is outside of said cavity;

a spring operably connected to said blade to bias said blade to said deployed position;

an actuator releasably engaged with said blade, wherein said actuator has a hold position that engages with said blade so that said actuator prevents movement of said blade with respect to said casing and a release position that permits movement of said blade with respect to said casing;

a safety operably connected to said actuator, wherein said safety has a lock position that prevents operation of said actuator and an unlock position that permits operation of said actuator; and said safety defines a projection, said casing defines a recess, and said projection of said safety is engaged with said recess of said casing when said safety is in said lock position and disengaged from said recess when said safety is in said unlock position.

9. The switchblade as in claim 8, wherein said safety is biased in said lock position.

10. The switchblade as in claim 8, wherein said safety moves in a first direction from said lock position to said unlock position, said actuator moves in a second direction from said hold position to said release position, and said first direction is perpendicular to said second direction.

11. The switchblade as in claim 8, wherein said blade defines a detent that engages with said actuator in said hold position.

12. The switchblade as in claim 8, wherein said spring moves said blade linearly when said actuator is placed in said release position.

13. The switchblade as in claim 8, further comprising a charging handle in sliding engagement with said casing, wherein said charging handle moves with respect to said casing to engage said blade to overcome said spring bias to move said blade to said retracted position.

14. The switchblade as in claim 13, further comprising a releasable latch between said charging handle and said casing.

15. The switchblade as in claim 14, wherein said releasable latch is pivotally connected to said charging handle.

* * * * *